US008858236B2

(12) United States Patent
Richard

(10) Patent No.: US 8,858,236 B2
(45) Date of Patent: Oct. 14, 2014

(54) ROTATABLE PLUG ASSEMBLY AND METHOD OF REDUCING STRAIN IN A WIRE

(75) Inventor: Jesse Richard, Racine, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 425 days.

(21) Appl. No.: 13/284,283

(22) Filed: Oct. 28, 2011

(65) Prior Publication Data

US 2013/0105595 A1 May 2, 2013

(51) Int. Cl.

| | |
|---|---|
| ***H01R 39/00*** | (2006.01) |
| ***H01R 39/64*** | (2006.01) |
| ***H01R 24/68*** | (2011.01) |
| ***H01R 35/04*** | (2006.01) |
| *H01R 103/00* | (2006.01) |

(52) U.S. Cl.

CPC ..... *H01R 39/64* (2013.01); *H01R 24/68* (2013.01); *H01R 35/04* (2013.01); *H01R 2103/00* (2013.01)

USPC ..... 439/21; 439/456

(58) Field of Classification Search

CPC ..... H01R 39/64; H01R 24/68; H01R 35/04; H01R 2103/00

USPC ..... 439/13, 21, 164, 456, 640; 362/93, 95

See application file for complete search history.

(56) References Cited

U.S. PATENT DOCUMENTS

| | | | | |
|---|---|---|---|---|
| 1,613,647 | A | 1/1927 | Davies et al. | |
| 3,474,376 | A | 10/1969 | Preiss | |
| 3,780,260 | A * | 12/1973 | Elsner | 392/392 |
| 4,458,228 | A | 7/1984 | Baumgartner | |
| 4,785,240 | A | 11/1988 | Newell et al. | |
| 5,595,503 | A | 1/1997 | Pittman et al. | |
| 5,647,053 | A | 7/1997 | Schroeder | |
| 6,402,352 | B1 | 6/2002 | Summerford et al. | |
| 7,052,281 | B1 | 5/2006 | Meyberg et al. | |
| 7,375,282 | B2 | 5/2008 | James | |
| 7,665,997 | B1 | 2/2010 | Lin | |
| 7,727,003 | B2 * | 6/2010 | Ceroll et al. | 439/447 |
| 7,914,292 | B2 * | 3/2011 | Honda | 439/21 |
| 2003/0194225 | A1 | 10/2003 | Pedrotti | |
| 2010/0285687 | A1 | 11/2010 | Wadsworth | |
| 2011/0097914 | A1 | 4/2011 | Lee | |

FOREIGN PATENT DOCUMENTS

| | | |
|---|---|---|
| EP | 0362397 | 4/1990 |
| EP | 0696457 | 2/1996 |
| EP | 1332765 | 8/2003 |
| EP | 1714662 | 10/2006 |
| WO | WO 02/26274 | 4/2002 |

(Continued)

OTHER PUBLICATIONS

GLADE.COM; "PlugIns Scented Oil"; Oct. 22, 2011; XP002630155.

(Continued)

*Primary Examiner* — Khiem Nguyen

(57) ABSTRACT

A rotatable electrical plug assembly for a volatile material dispenser includes a support block having first and second opposing lateral sides and electrical plug pins extending from the support block and including terminals connected to the plug pins. The plug assembly further includes a wire extending from one of the terminals toward the first side of the support block, wherein the wire forms a loop between the terminals and the first side and further extends toward the second side of the support block.

20 Claims, 13 Drawing Sheets

(56) References Cited

FOREIGN PATENT DOCUMENTS

| | | |
|---|---|---|
| WO | WO 03/013618 | 2/2003 |
| WO | WO 03/088430 | 10/2003 |
| WO | WO 2005/079874 | 9/2005 |
| WO | WO 2008/107366 | 9/2008 |
| WO | WO 2008/156805 | 12/2008 |

OTHER PUBLICATIONS

PCT/US2012/061785 International Search Report dated Jan. 24, 2013.
PCT/US2012/056254 International Search Report and Written Opinion dated Apr. 15, 2013.

* cited by examiner

ROTATABLE PLUG ASSEMBLY AND METHOD OF REDUCING STRAIN IN A WIRE

CROSS REFERENCE TO RELATED APPLICATIONS

Not applicable.

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to a rotating electrical plug assembly and, more particularly, to a plug assembly and method for reducing strain on one or more wires within a volatile material dispenser.

2. Description of the Background of the Invention

Various volatile material dispensers are known in the prior art and generally include a housing with a refill inserted therein. The refill generally includes a container for holding a volatile material therein. In some dispensers, the volatile material is passively emitted therefrom. In other dispensers, a diffusion element is utilized to facilitate the dispensing of the volatile material. Examples of diffusion elements include heaters, piezoelectric elements, fans, aerosol actuators, and the like. Regardless of the manner in which the volatile material is emitted, once the volatile material has been expended from the refill, the refill is removed by a user and replaced with a new refill.

One type of volatile material dispenser, referred to herein as a plug-in scented oil dispenser, includes a housing and a heater disposed within the housing. A refill for use with a plug-in scented oil dispenser generally includes a container with a volatile material therein and a wick in contact with the volatile material and extending out of the refill. Upon insertion of the refill into the dispenser, at least a portion of the wick is disposed adjacent the heater such that volatile material that moves through the wick is volatilized by the heater. The volatile material dispenser typically includes a plug assembly having electrical prongs extending outwardly from the housing. The electrical prongs are inserted into a standard electrical outlet and thereafter supply electrical energy to the volatile material dispenser. Plug-in scented oil dispensers may also utilize a fan to aid in vaporizing and dispersing volatile material.

One of the disadvantages of many of the volatile material dispensers and refills therefore, such as the plug-in scented oil dispenser discussed above, is that the plug assembly and electrical prongs are oriented in such a way so as to be compatible with only a single orientation of the volatile material dispenser with respect to the electrical outlet. For example, the vertical orientation of the electrical prongs with respect to the volatile material dispenser only allows a user of the volatile material dispenser to insert the dispenser in an upright manner into a vertically oriented electrical outlet. The user must rotate the volatile material dispenser in a horizontal manner to insert the volatile material dispenser into a horizontally oriented electrical outlet. Rotation of the dispenser in this manner is undesirable for numerous reasons including, at least, that the volatile material may leak from the dispenser and/or be removed from contact with the wick if the dispenser is disposed in a horizontal position.

A solution has been attempted to try to remedy the aforementioned problems in the form of a rotating plug assembly, which allows the rotation of the electrical prongs on the plug assembly from a vertically oriented position to a horizontally oriented position. The user may then adjust the plug assembly based on the desired orientation, which allows the volatile material dispenser to remain upright, while still receiving electrical energy. However, a further problem is created by the continued rotation of the plug assembly of the present devices utilizing such an assembly. Specifically, strain is created on various portions of the plug assembly during rotation, which causes the plug assembly parts to fatigue over time. The fatigue may lead to loose wires in the plug assembly that could create unstable connection points between the plug assembly and the wires and render the volatile material dispenser inoperable. It is therefore desirable to manufacture plug assemblies for volatile material dispensers that place a minimal amount of strain and stress on the wires during rotation of the plug assembly.

SUMMARY

According to one aspect of the present invention, a rotatable electrical plug assembly for a volatile material dispenser includes a support block having first and second opposing lateral sides and electrical plug pins extending from the support block and including terminals connected to the plug pins. The plug assembly further includes a wire extending from one of the terminals toward the first side of the support block, wherein the wire forms a loop between the terminals and the first side and further extends toward the second side of the support block.

In a different aspect of the present invention, a volatile material dispenser includes a housing adapted to receive a container and an electrical plug assembly rotatably retained within an opening of the housing. The plug assembly includes a support block, electrical plug pins extending outwardly from the support block, and terminals extending from the plug pins. Wires extend from the terminals in a first direction perpendicular to the plug pins, wherein the wires form loops and further extend in a second direction opposite the first direction.

In a further aspect of the present invention, a method of reducing strain in a wire connected to an electrical plug assembly of a volatile material dispenser includes the step of providing a volatile material dispenser having a housing adapted to receive a container. The method further includes the step of providing an electrical plug assembly within an opening in the housing, wherein the plug assembly includes a support block having first and second opposing lateral sides and electrical plug pins extending from the support block and including terminals at an end thereof. The method still further includes the step of routing a wire from one of the terminals toward the first side of the support block, wherein the wire forms a loop between the terminals and the first side and then extends toward the second side of the support block.

BRIEF DESCRIPTION OF THE DRAWINGS

Other aspects and advantages of the present invention will become apparent upon consideration of the following detailed description, wherein similar structures have like or similar reference numerals.

DETAILED DESCRIPTION

The present invention is directed to an electrical plug assembly for a volatile material dispenser. While the present invention may be embodied in many different forms, several specific embodiments are discussed herein with the understanding that the present invention is to be considered only as an exemplification of the principles of the invention, and it is not intended to limit the invention to the embodiments illustrated.

Figure 1:
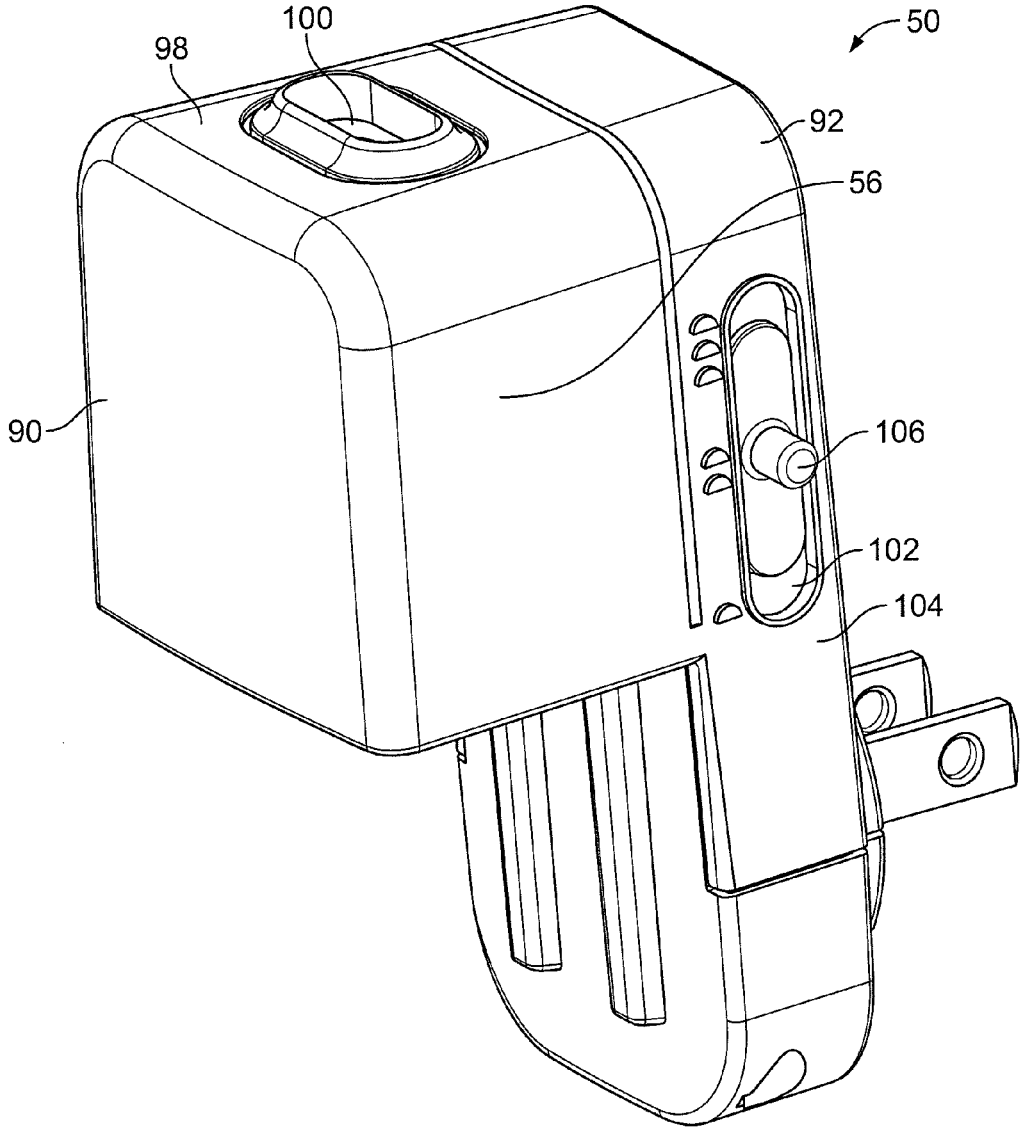
FIG. 1 is a top and side isometric view of a dispenser.
Figure 2:
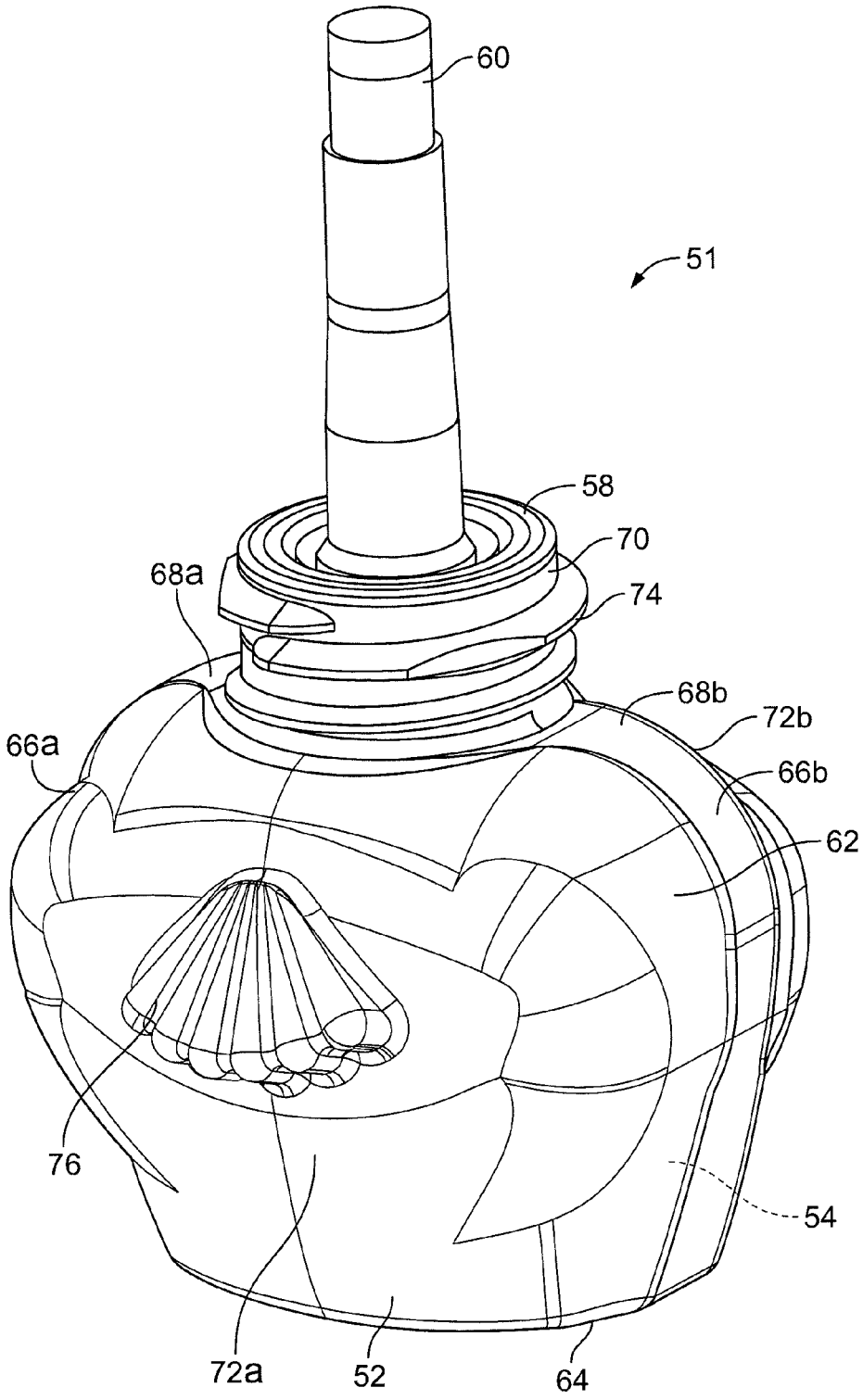
FIG. 2 is a top isometric view of a refill for insertion within the dispenser of FIG. 1.

Referring to the drawings, FIG. 1 depicts a volatile material dispenser 50 adapted to accommodate a refill 51, as seen in FIG. 2, including a container 52 with a volatile material 54 therein, wherein the container 52 is adapted to be retained by a housing 56. The container 52 includes a retaining mechanism 58 to hold a wick 60 within the container 52. The container 52 includes a body 62 with the volatile material 54 disposed therein. The body 62 includes a base portion 64 and first and second opposing sidewalls 66*a*, 66*b* that extend upwardly and outwardly prior to curving inwardly toward first and second top walls 68*a*, 68*b*, respectively. The first and second top walls 68*a*, 68*b* are integral with a neck 70. Similarly, third and fourth opposing front and rear walls 72*a*, 72*b*, respectively, curve upwardly toward the neck 70.

The neck 70 includes a threaded portion 74 disposed on an outer surface thereof and an opening (not shown) disposed through a top portion thereof, wherein the opening allows access to the volatile material 54. The container 52 further optionally includes raised portions 76 extending outwardly from one or more of the third and fourth opposing front and rear walls 72*a*, 72*b*. In one embodiment, the raised portions 76 are in the form of inverted shell-shaped members. Although a specific dispenser 50 and container 52 are described with particularity, it is contemplated that any type of electrical dispenser and any type of container may be used with the electrical plug assemblies described herein. For example, dispensers useful for the present invention include, but are not limited to, the dispensers described in Belongia et al. U.S. Pat. No. 7,840,123, Varanasi et al. U.S. Pat. No. 6,968,124, Beland et al. U.S. Patent Application Publication No. 2011/0049259, Zobele U.S. Patent Application Publication No. 2005/0180736, and Pedrotti et al. U.S. Patent Application Publication No. 2003/0194225. Further, containers useful for the present invention include, but are not limited to, the containers described in U.S. Pat. No. 7,032,831, and the containers described in U.S. patent application Ser. No. 12/969,261, filed on Dec. 15, 2010, both of which are owned by the same assignee as the present invention.

The volatile material 54 disposed in the container 52 may be any type of volatile material adapted to be dispensed into an environment. For example, the container 52 may include a cleaner, an insecticide, an insect repellant, an insect attractant, a disinfectant, a mold or mildew inhibitor, a fragrance, a disinfectant, an air purifier, an aromatherapy scent, an antiseptic, an odor eliminator, a positive fragrancing volatile material, an air-freshener, a deodorizer, or the like, and combinations thereof. Additives may be included in the volatile material, such as, for example, fragrances and/or preservatives.

Figure 3:
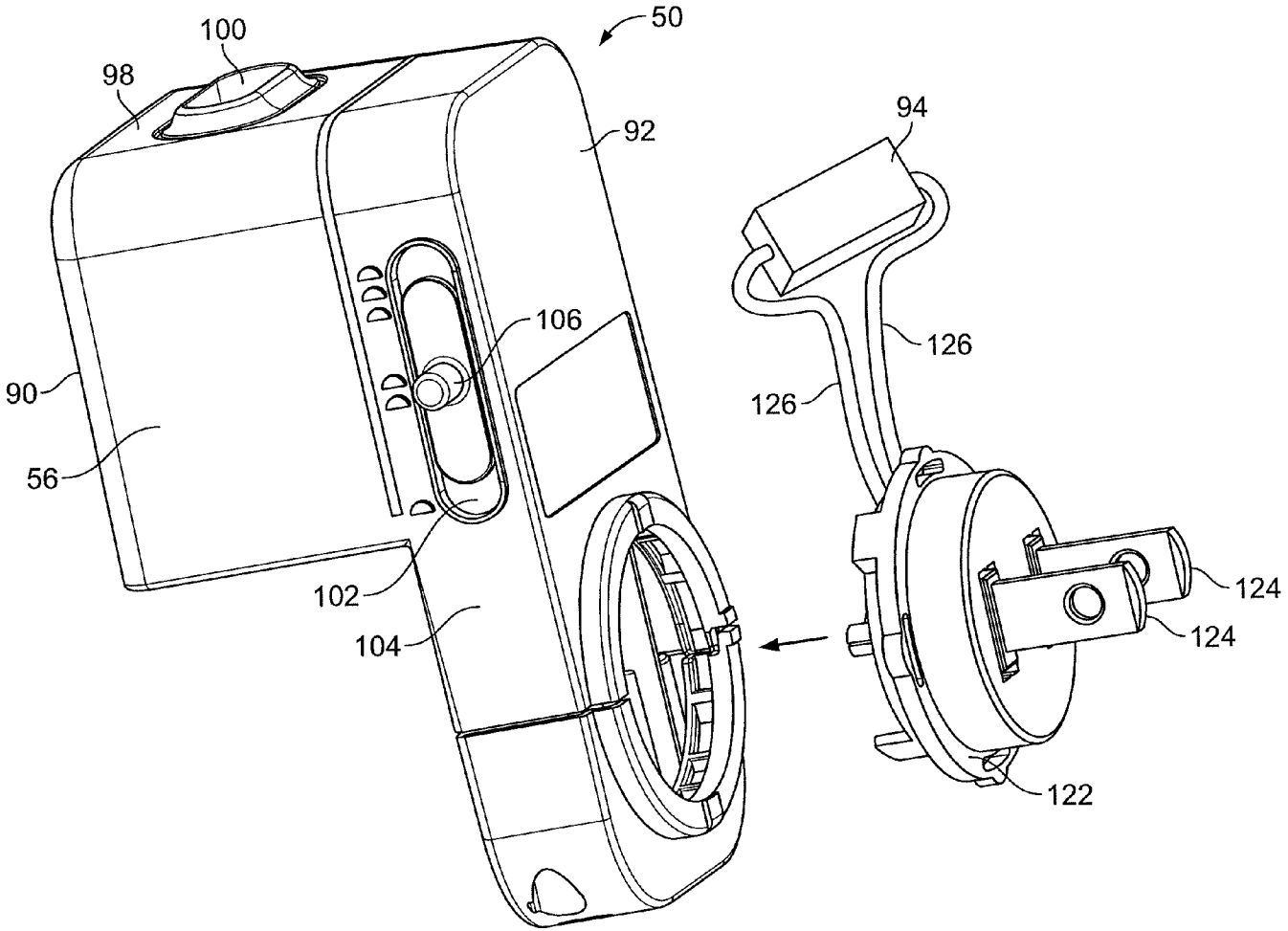
FIG. 3 is an exploded view of the dispenser of FIG. 1.

Now turning generally to FIGS. 1 and 3, the housing 56 of the volatile material dispenser 50 includes front and rear portions 90, 92 attached to one another to form a chamber (not shown) therebetween. The container 52 is inserted into the housing 56 by inserting the wick 60 upwardly into the chamber. The container 52 is retained within the housing 56 by conventionally known means, including a snap-fit connection, a threaded interaction, and the like. In this embodiment, a portion of the wick 60 is disposed adjacent a heater 94 (see FIG. 3) that is disposed in the housing 56. The front portion 90 of the housing 56 includes an upper surface 98 having an opening 100 for release of volatile material therethrough. A further opening 102 is disposed in a side wall 104 of the rear portion 92 of the housing 56 and a switch 106 extends through the opening 102 for adjustment of one or more functions of the dispenser 50 (for example, intensity, timing, temperature, or the like). As noted above, the dispenser 50 may be any electric dispenser for insertion into a conventional electrical socket and may include any number of adjustment features, vents, or other features, as known in the art.

Although the plug assemblies herein are described as being utilized with dispensers that utilize refills with plug-in scented oils, the plug assemblies may be utilized for any electrical dispenser from which any type of volatile material is dispensed out of any type of refill. In particular, the plug assemblies may be utilized with dispensers having one or more of a heater, a fan, a piezoelectric element, and/or other components disposed in a housing thereof to help facilitate the release of volatile material. Any of the aforementioned components may be electrically connected to the plug assemblies in manners described herein, as may any other electrical components of the dispenser, for example, microcontrollers, application specific integrated circuits, lights, light-emitting diodes, or any other electrical components for use within volatile material dispensers.

Now referring to FIG. 3, the dispenser 50 includes a circular opening 120 in the rear portion 92 of the housing 56. A plug assembly 122 is rotatably retained within the opening 120. Specifically, as is known in the art, the plug assembly 122 includes one or more features that allow the plug assembly 122 to fit within the opening and rotate through an angle of about 90 degrees. In other embodiments, the plug assembly 122 may rotate at angle degree up to about 270 degrees. The plug assembly 122 includes one or more plug pins 124 extending therefrom for connection to a conventional electrical outlet. Although two plug pins 124 are depicted that are adapted to fit within a conventional US electrical outlet, any number, size, and shape of plug pins 124 may be utilized for use in electrical outlets of other countries. As will be discussed in greater detail hereinafter, the plug pins 124 are electrically connected to wires 126 that extend from the plug pins 124 to electrical components, such as the heater 94, within the dispenser 50. When the refill 51 is inserted into the dispenser 50, at top end of the wick 60 is situated adjacent the heater 128. Although the dispenser is depicted as having a heater 94, the plug assemblies 122 disclosed herein may be utilized with dispensers having any electrical component or multiple electrical components, including, but not limited to, piezoelectric devices, aerosol actuators, lights, sound emitters, indicators, electronic circuits, microcontrollers, and the like.

Figure 4:
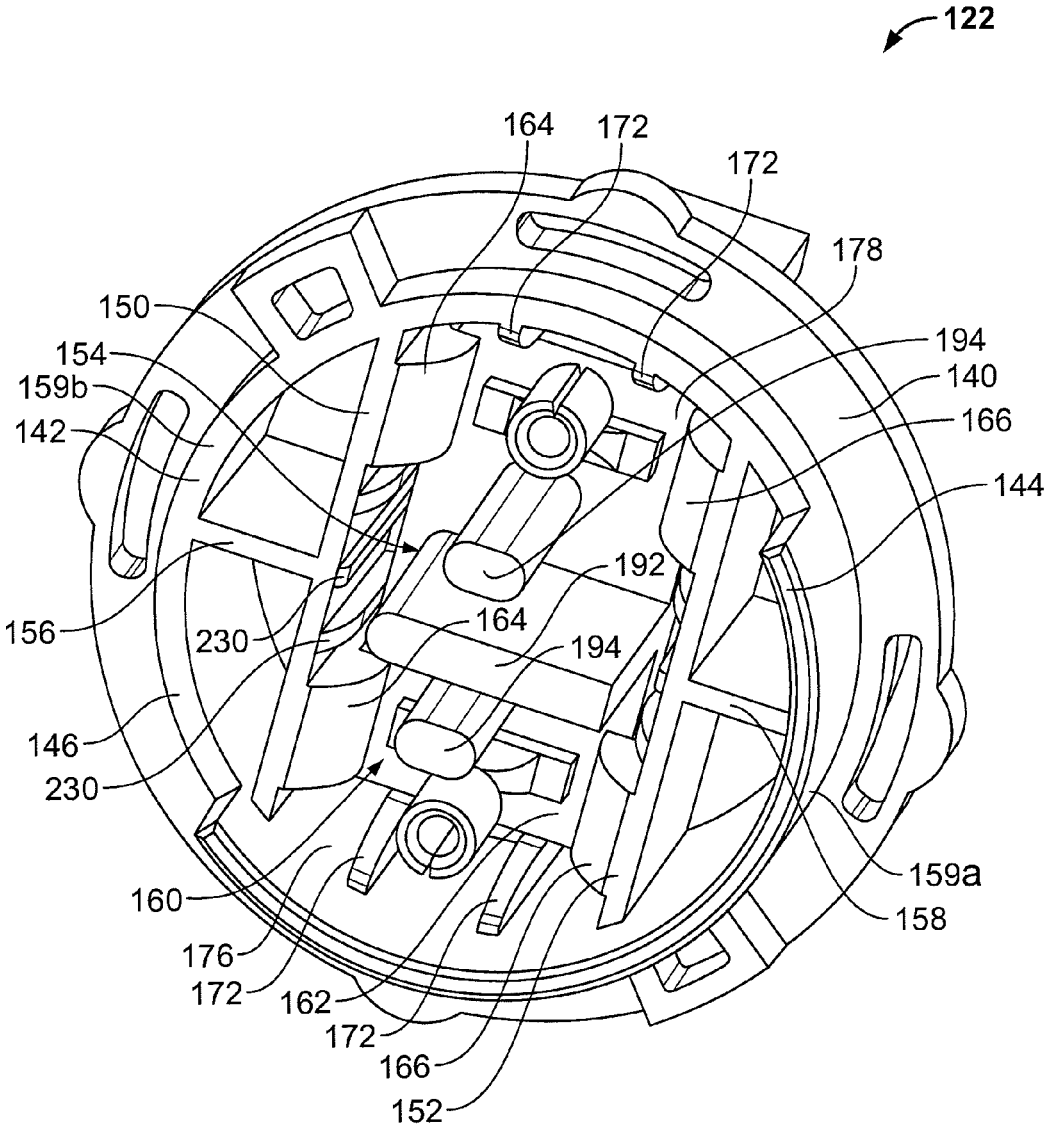
FIG. 4 is a side isometric view of a plug assembly for use within the dispenser of FIG. 1.
Figure 5:
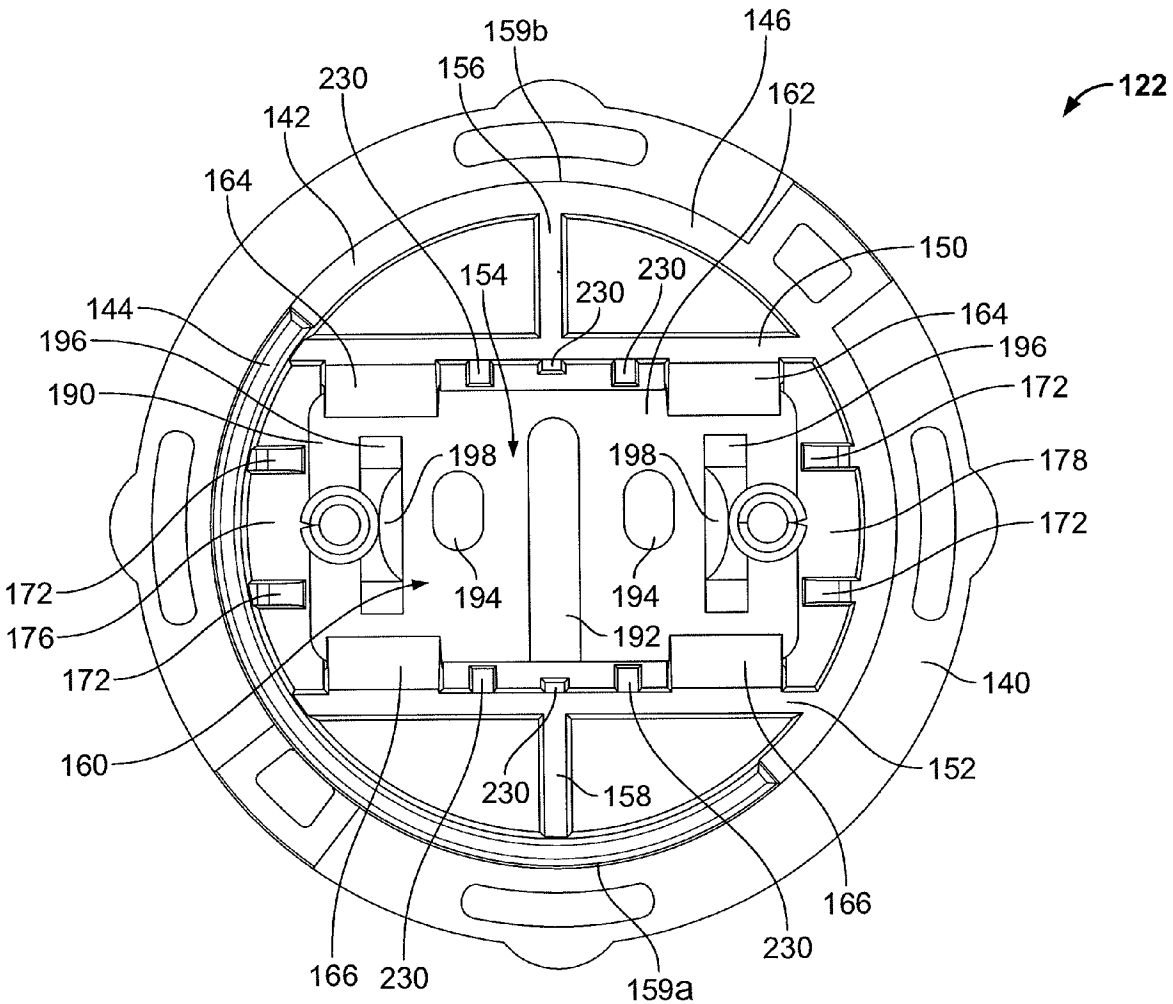
FIG. 5 is a side elevational view of the plug assembly of FIG. 4.
Figure 6:
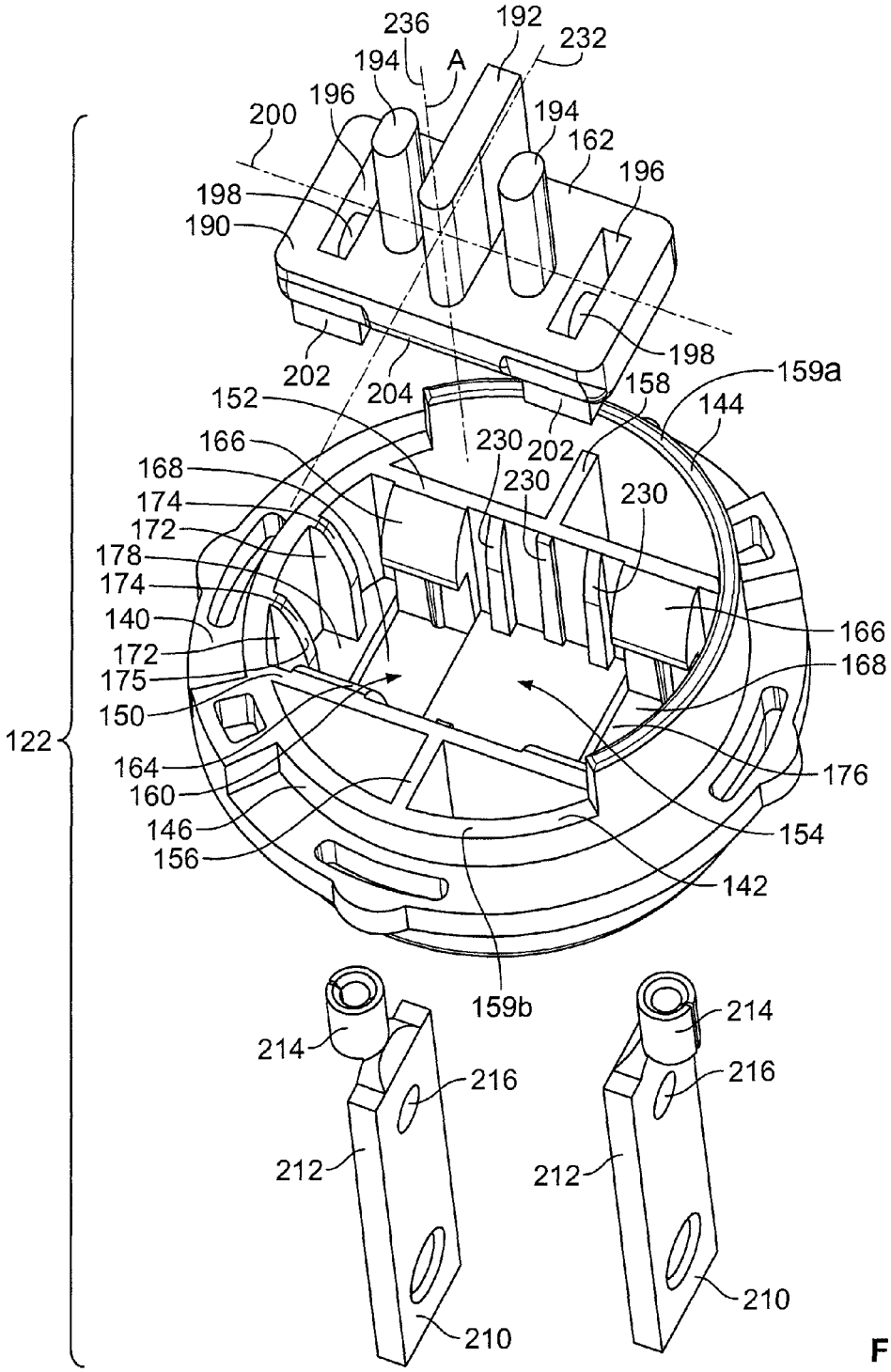
FIG. 6 is an isometric exploded view of the plug assembly of FIG. 4.

The plug assembly 122 is depicted in detail in FIGS. 4-7. In particular, the plug assembly 122 includes a support block 140 that provides a base for the plug assembly 122. As noted above, the support block 140 can be rotated about 90 degrees about an axis A (FIG. 6). The rotational capabilities enable the dispenser 50 to be plugged into a conventional electrical outlet so that the wick 60 is approximately perpendicular to the ground regardless of an orientation of openings of the electrical outlet (i.e., parallel or perpendicular to the ground). In other embodiments, the plug assembly 122 may be rotated a full 360 degrees or any degree in between 0 and 360 degrees, for example, 180 degrees.

Still referring to FIGS. 4-7, the plug assembly 122 includes a cylindrical wall 142 extending upwardly from the support block 140 and including a first segment 144 that extends about 180 degrees and a second segment 146 that extends about 180 degrees. The first segment 144 has a height component that is greater than a height component of the second segment 146. The second segment 146 acts as an opening for routing of the wires 126 out of the plug assembly 122. In other embodiments, the first or second segments 144, 146 is greater or less than 180 degrees. Specifically, the second segment 146 need only be large enough for routing of the wires 126 out of the plug assembly 122 without adding additional strain to the wires 126.

The plug assembly 122 further includes first and second parallel walls 150, 152 equidistantly spaced from a center 154 of the support block 140 and extending between opposing sides of the cylindrical wall 142. The walls 150, 152 are supported by respective support walls 156, 158 extending toward first and second lateral sides 159*a*, 159*b* of the support block 140 and forming a generally rectangular central compartment 160 for retention of a pin bridge 162. In order to reduce strain on the wires 126, as will be discussed in greater detail hereinafter, height components of the walls 150, 152 are generally the same and generally the same as the second segment 146 and less than the height component of the first segment 144.

Figure 7:
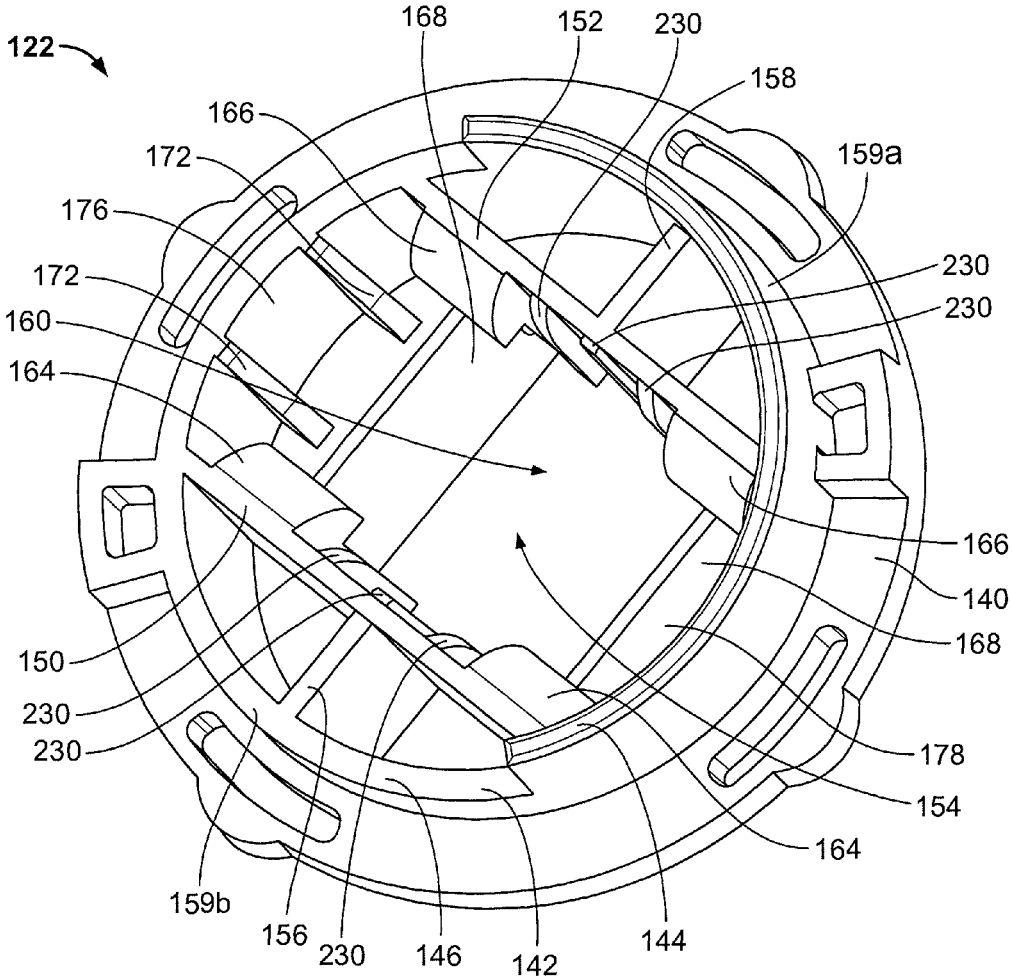
FIG. 7 is a side isometric view of the plug assembly of FIG. 4 with a pin bridge and plug pins thereof removed.
Figure 8:
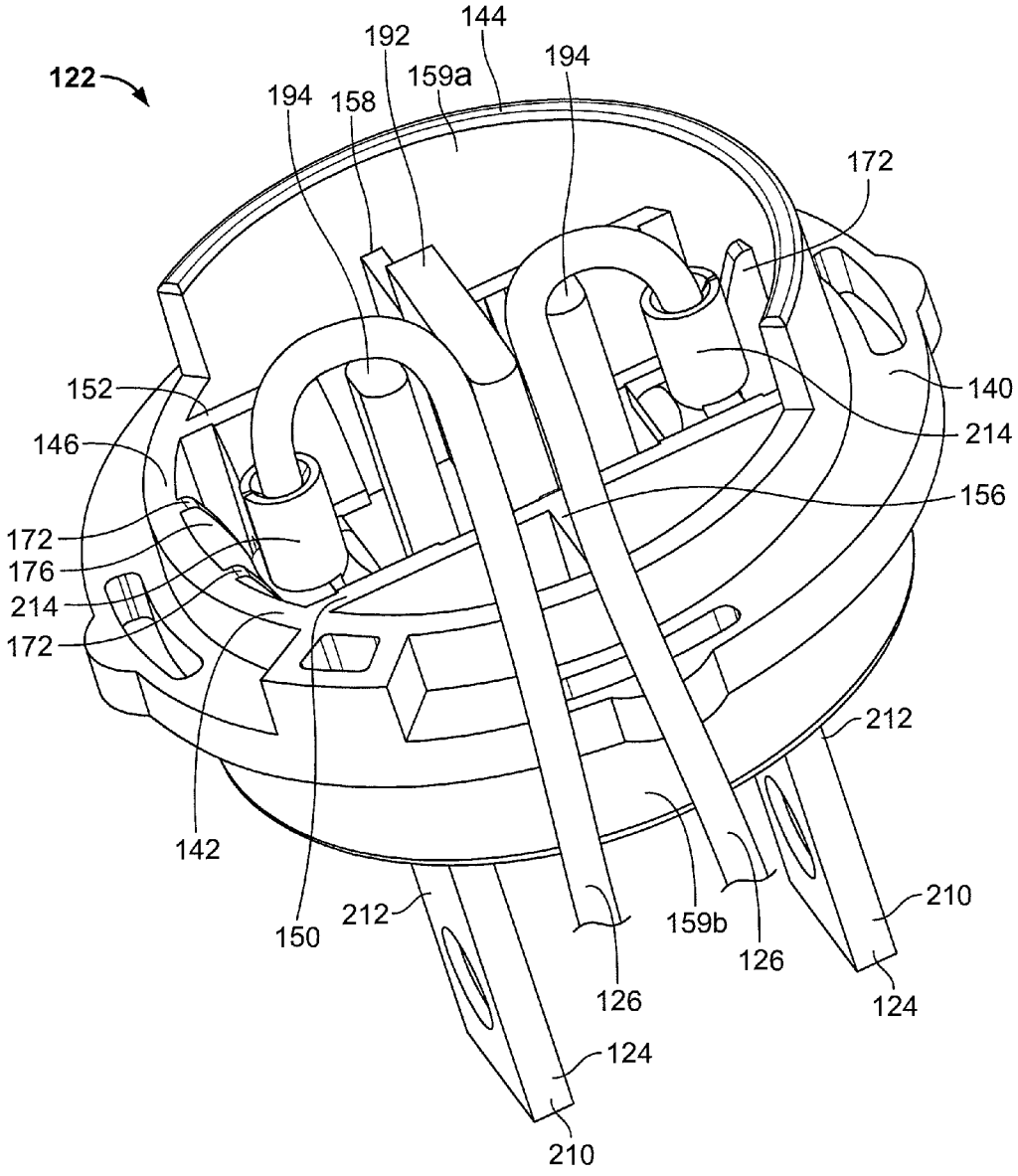
FIG. 8 is a side isometric view of the plug assembly of FIG. 4 with wires attached to terminals extending from the plug assembly.

As best seen in FIGS. 6 and 7, each of the walls 150, 152 includes a set of resilient latches 164, 166, respectively, extending inwardly therefrom into the central compartment 160 and generally aligned with rectangular apertures 168 (FIG. 6) extending through the support block 140. In addition, stabilizing wedges 172 are disposed at opposing ends 176, 178 of the central compartment 160, wherein each of the wedges 172 has a curved section 175 that continues into a straight section 176 that is generally perpendicular to the support block 140.

The pin bridge 162 is generally symmetrical and includes a planar base 190 with a central upstanding wall 192 and two elongated cylindrical projections 194 disposed on either side of the wall 192 and spaced outwardly a short distance from the wall 192, such that a minimal gap is maintained between each of the wires 126, the wall 192, and respective projections 194. The wall 192 and the cylindrical projections 194 have a height component that is generally the same. The pin bridge 162 further includes two rectangular channels 196 disposed through the base 190 and spaced outwardly of the projections 194. A generally circular projection 198 (FIGS. 5 and 6) extends across each of the channels 196 and parallel to a longitudinal axis 200 (FIG. 6) of the pin bridge 162, the function of which will be discussed in greater detail hereinafter. Support members 202 extend outwardly from an outer surface 204 of the base 190, wherein the support members 202 extend into the rectangular apertures 168 after assembly of the plug assembly 122 and provide support for the plug pins 124. Although the projections 194 are described and shown as being generally cylindrical in cross-sectional shape, the projections 194 may have any shape, as long as the projections 194 function in the intended manner, which will be discussed in detail hereinafter.

As best seen in FIG. 6, each of the plug pins 124 includes a first and a second end 210, 212, wherein the first end 210 is inserted into a conventional electrical outlet and the second end includes terminals 214 for electrical connection of the wires 126. Each plug pin 124 also includes an aperture 216 that is spaced from the second end 212.

Assembly of the plug assembly 122 will now be discussed in detail with reference to FIGS. 4-6. During the manufacturing process, the plug pins 124 are inserted into the channels 196 in the base 190 of the pin bridge 162 with the circular projections 198 extending through the apertures 216 in the plug pins 124 to fixedly retain the plug pins 124 within the pin bridge 162. Once the plug pins 124 and pin bridge 162 are assembled, the assembly is inserted into the support block 140. In particular, the plug pins 124 are inserted into the rectangular apertures 168 in the support block 140 and the pin bridge 162 is snapped into the central compartment 160. As the pin bridge 162 is pushed into the compartment 160, the pin bridge 162 pushes outwardly on the resilient latches 164, 166, which causes the latches 164, 166 to move outwardly until the pin bridge 162 has passed the latches 164, 166 and fits within a spaced confined by the latches 164, 166 and the latches 164, 166 snap back to their original position (biased inwardly). During this portion of the assembly process, the curved sections 174 of the stabilizing wedges 172 provide guides for the pin bridge 162 and the straight sections 176 of the stabilizing wedges 172 prevent movement of the pin bridge 162 in the longitudinal direction 200. The latches 164, 166 and a plurality of additional stabilizing wedges 230 prevent movement of the pin bridge 162 in a lateral direction 232 (FIG. 6), which is perpendicular to the longitudinal direction 200. Still further, the latches 164, 166 and an inner surface 234 of the support block 162 prevent movement of the pin bridge 162 in a direction 236 (FIG. 6) parallel to the plug pins 124. The pin bridge 124 (and therefore the plug pins 124) is therefore fixedly retained, with little or no movement, within the support block 162.

Figure 9:
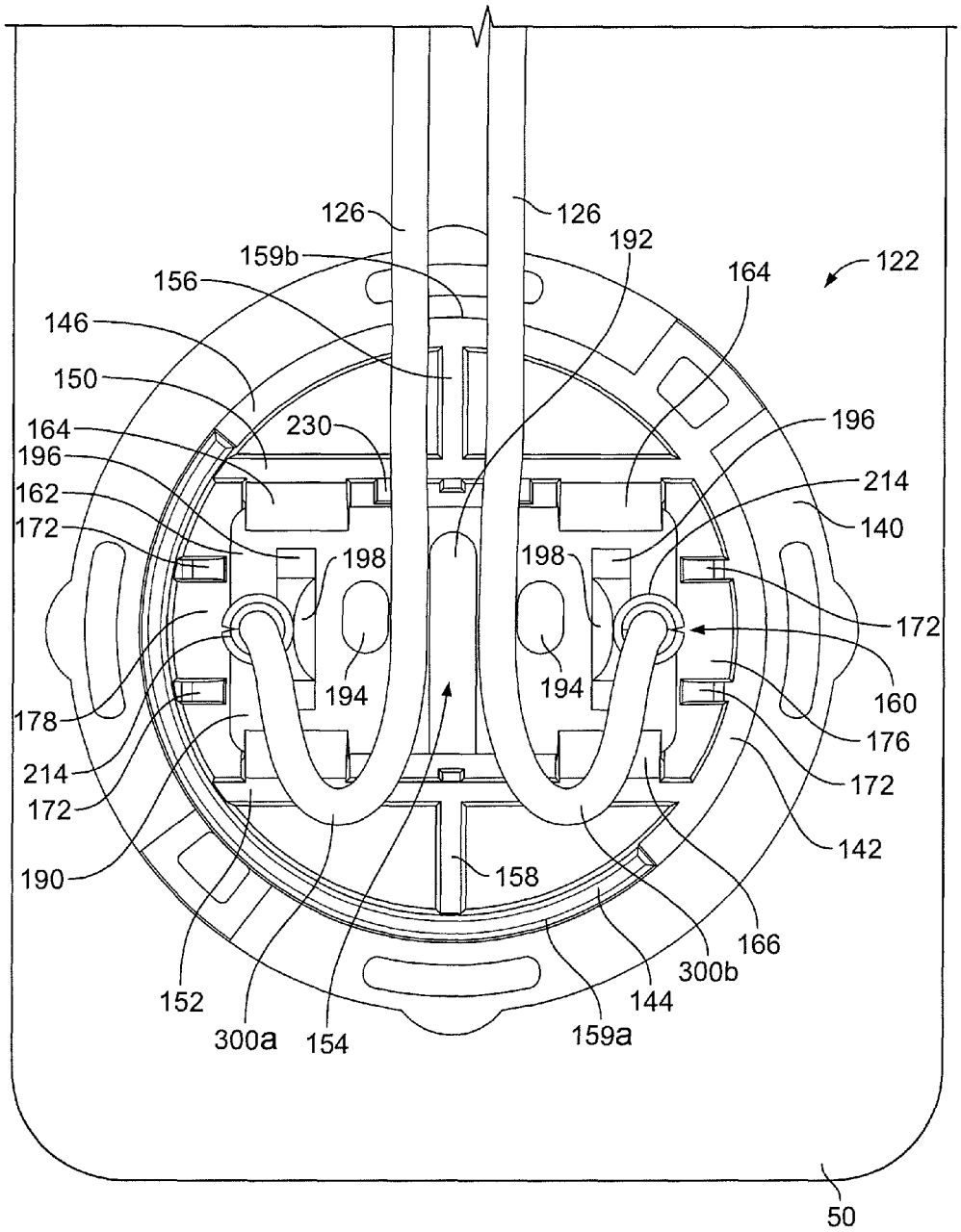
FIG. 9 is a side elevational view of the plug assembly of FIG. 4 with wires attached to terminals extending from the plug assembly, the plug assembly being in an original position before the plug assembly has been rotated and generally depicting the plug assembly within the dispenser of FIG. 1.

As can best be seen in FIGS. 8-11, exposed ends of the wires 126 are crimped to the terminals 214 and the wires 126 are bent at an angle of about 90 degrees before being routed through the plug assembly 122. In particular, the wires 126 extend in a first direction toward the first segment 144 of the cylindrical wall 142 and the second wall 152. The wires 126 turn adjacent or just past the second wall 152 and are thereafter routed toward the first wall 150 and the second segment 146 of the cylindrical wall 142. As the wires 126 are routed toward the first wall 150, a portion of each of the wires 126 is positioned between the upstanding wall 192 and respective cylindrical projections 194. The wires 126 are movably retained between the upstanding wall 192 and respective cylindrical projections 194. FIG. 9 depicts the wires 126 extending from the plug assembly 122 toward an electrical component within the dispenser 50 prior to any rotation of the plug assembly 122. The wires 126 are formed into loops 300*a*, 300*b* near the second wall 152 and are retained between the upstanding wall 192 and respective cylindrical projections 194 with the wires 126 extending in a generally straight manner within the dispenser 50.

Figure 10:
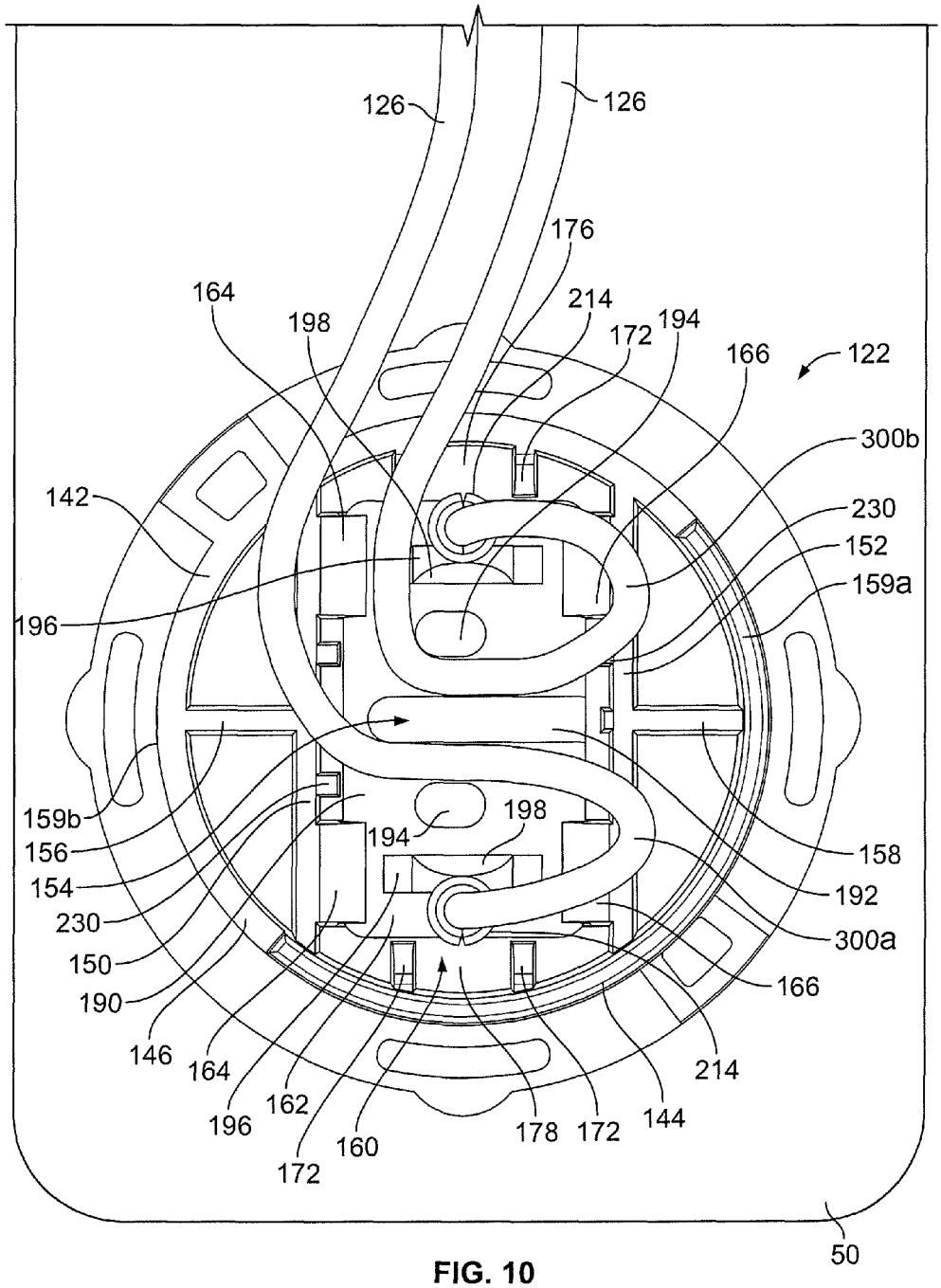
FIG. 10 is a side elevational view similar to that of FIG. 9 depicting the wires after the plug assembly has been rotated 90 degrees.

FIG. 10 depicts the plug assembly 122 and wires 126 after the plug assembly 122 has been rotated 90 degrees (to the left in FIG. 10). A length of the wires 126 needs to be great enough that, during rotation, the wires 126 have enough length to pull without causing too must strain or fatigue in the wires 126. As seen in FIG. 10, the wire 126 forming the loop 300*a* needs more length because of the direction of rotation and the distance between the respective terminal 214 and the electrical component (being greater after rotation), and therefore, the wire 126 forming the loop 300*a* moves outwardly through the space between the wall 192 and the respective projection 194 to extend the wire 126 and lessen a size of the loop 300*a*. In a similar manner, due to the direction of rotation and the distance between the respective terminal 214 and the electrical component (being less after rotation), the wire 126 forming the loop 300*b* need not be as long as the wire 126 forming the loop 300*a*, and thus, the wire 126 moves inwardly between the wall 192 and the respective projection 194, thereby enlarging a size of the loop 300*b*.

Figure 11:
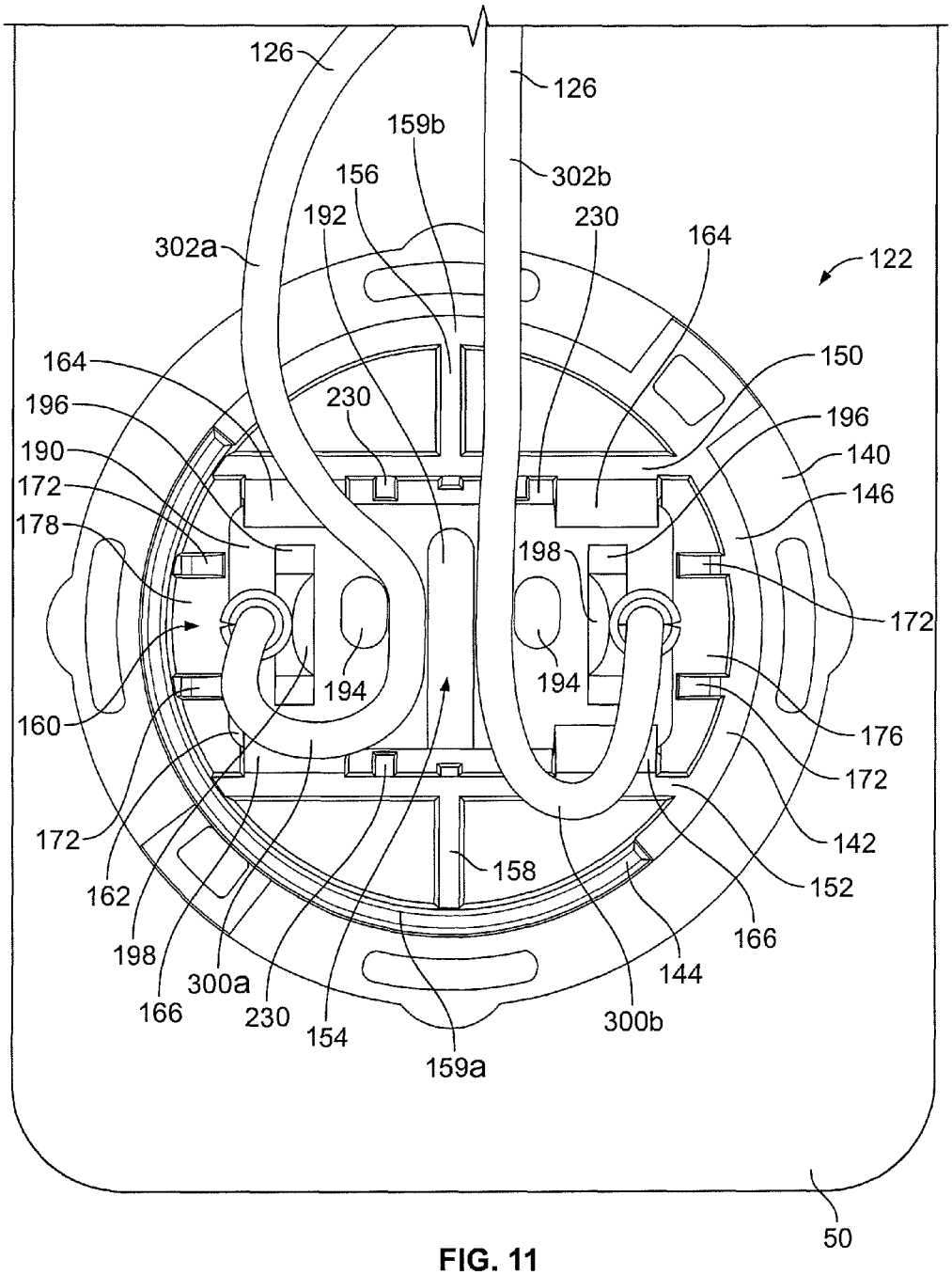
FIG. 11 is a side elevational view similar to that of FIG. 9 depicting the wires after the plug assembly has been rotated from the position of FIG. 10 back to the original position of FIG. 9.

Referring to FIG. 11, when the plug assembly 122 is rotated back to its original position as seen in FIG. 9, the wires 126 remain in generally the same position between the wall 192 and respective projections 194 with radii of curvature 302*a*, 302*a* formed in the wires 126. The radius of curvature 302*a*, 302*b* of a wire 126 after rotating in the direction of that wire 126 will be greater than the radius of curvature 302*a*, 302*b* of the other wire 126, but regardless, the radii of curvature 302*a*, 302*b* of each wire 126 should be large, thereby leading to relatively straight wires 126. Retaining the wires 126 (between a point where they exit the compartment 160 and an electrical component of the dispenser 50) in a relatively straight condition regardless of the state of rotation prevents excess strain in the wires 126. In fact, bunching up and folding of wires within a dispenser, which is very common, causes strain and fatigue in the wires and, oftentimes, leads to failure of the wires.

The loops 302*a*, 302*b* are intended to be robust in that they can expand and contract as the plug assembly 122 is rotated without causing strain and fatigue in the wires 126 at the points where they are movably retained between the wall 192 and the projections 194.

The pin bridge 162 is intended to retain the plug pins 124 of the plug assembly 122. The wall 192 and the projections 194 of the pin bridge are intended to movably retain the wires 126, while also providing a visual cue for proper routing of the wires 126 during the manufacturing process.

Figure 12:
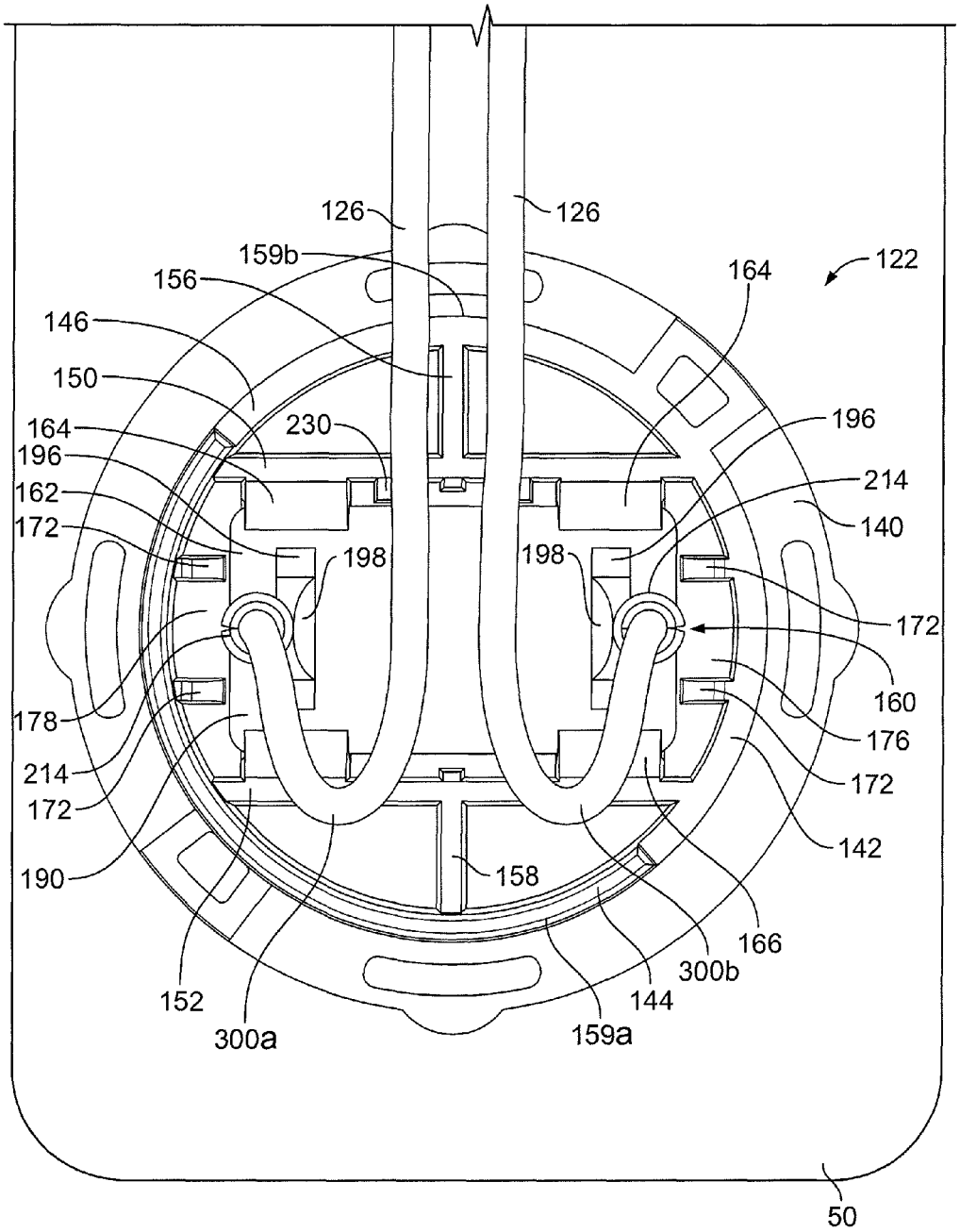
FIG. 12 is a view similar to that of FIG. 9 and depicting a further embodiment of a plug assembly for use with the dispenser of FIG. 1.
Figure 13:
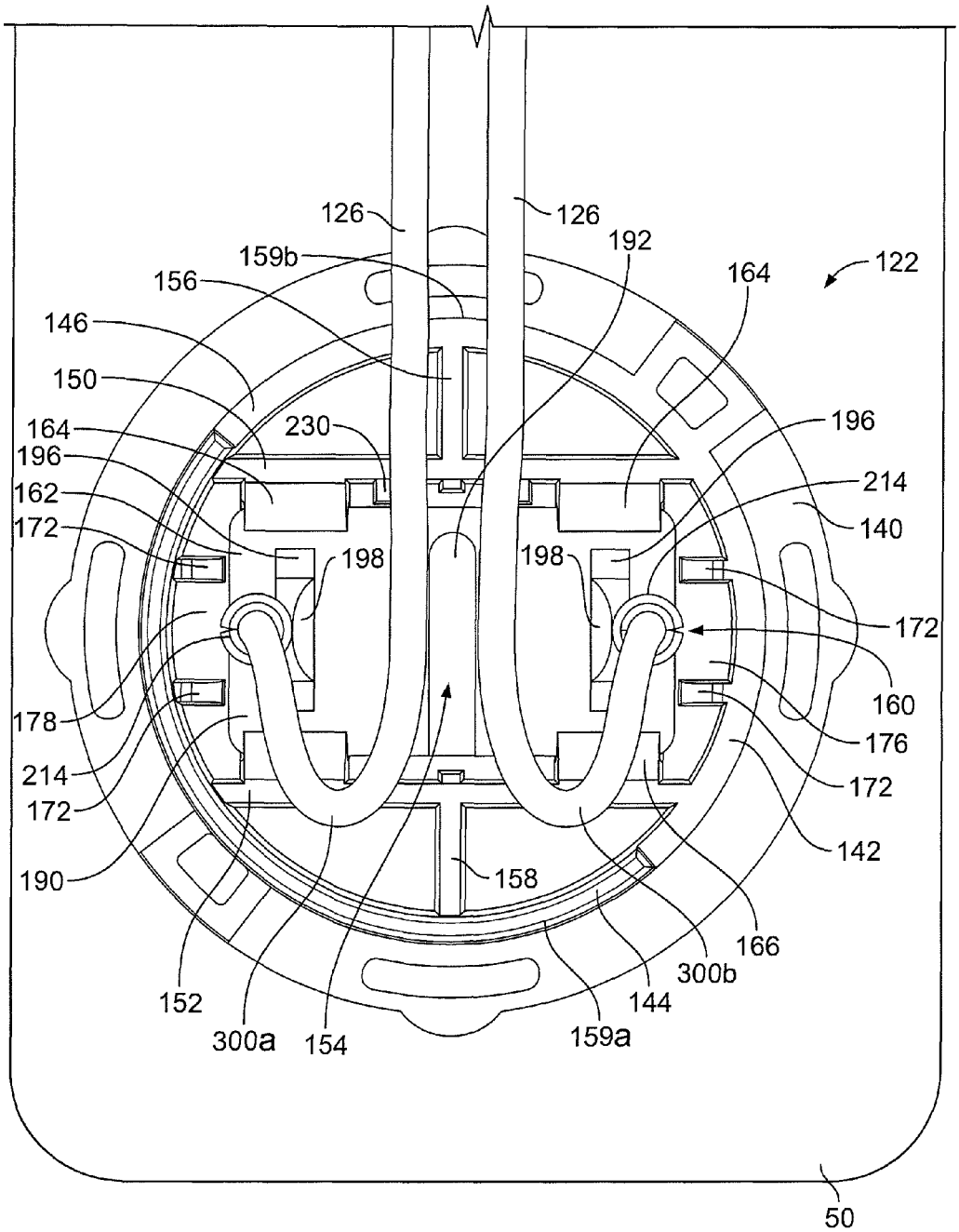
FIG. 13 is a view similar to that of FIG. 9 and depicting another embodiment of a plug assembly for use with the dispenser of FIG. 1.

In a further embodiment, as seen in FIG. 12, the pin bridge 162 of the plug assembly 122 does not include the wall 192 or the projections 194. In particular, as long as the wires 126 are routed and contained in the manner described herein, strain and fatigue within the wires 126 will be reduced. Optionally, in yet another embodiment, as shown in FIG. 13, only the wall 192 is utilized to guide and route the wires 126 in the manner described in detail above.

The dispensers disclosed herein may further include one or more openings in the housing to allow for the volatile material to be dispensed from the housing to the surrounding environment. The housing may include a variety of internal implements to help secure the various refills disclosed herein, such as, for example, snaps, ridges, undercuts, lips, notches, and/or other attachment methods. The dispensers may optionally include one or more refills and may operate using a variety of timing sequences as known in the art.

Any of the embodiments described herein may be modified to include any of the structures or methodologies disclosed in connection with other embodiments.

Further, although directional terminology, such as front, back, upper, lower, etc. may be used throughout the present specification, it should be understood that such terms are not limiting and are only utilized herein to convey the orientation of different elements with respect to one another.

All documents cited in the Detailed Description of the Invention are, in relevant part, incorporated herein by reference; the citation of any document is not to be construed as an admission that it is prior art with respect to the present invention.

INDUSTRIAL APPLICABILITY

The present invention provides volatile material dispensers having a rotating electrical plug assembly. The plug assemblies include a support block with plug pins extending out the support block. At least one wire is routed from at least one of the plug pins in a manner that decreases mechanical strain and fatigue on the wire(s).

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. A rotatable electrical plug assembly for a volatile material dispenser, the assembly comprising:

a support block having first and second opposing lateral sides;

electrical plug pins extending from the support block and including terminals connected to the plug pins; and a wire extending from one of the terminals toward the first side of the support block, wherein the wire forms a loop within the support block between the terminals and the first side and further extends toward the second side of the support block.

2. The rotatable electrical plug assembly of claim 1, wherein the wire is routed within the plug assembly in plane that is generally perpendicular to the electrical plug pins.

3. The rotatable electrical plug assembly of claim 1, wherein the electrical plug assembly may be rotated through an angle of about 90 degrees.

4. The rotatable electrical plug assembly of claim 3, wherein a wire extends from each of the terminals toward the first side of the support block, the wires forming respective loops between the terminals and the first side and further extending toward the second side of the support block and away from the support block.

5. The rotatable electrical plug assembly of claim 4, wherein the loops allow the wires to be pushed and pulled during rotation of the plug assembly with little strain on the wires at the terminals.

6. The rotatable electrical plug assembly of claim 4, further including a wall projecting from the support block away from the plug pins, wherein the wall is disposed centrally between the terminals and the wires are routed on opposite sides of the wall.

7. The rotatable electrical plug assembly of claim 6, wherein the wires touch the wall and, at the point where the wires touch the wall, the wires are generally parallel to a longitudinal extent of the wall.

8. The rotatable electrical plug assembly of claim 7, further including two posts projecting from the support block away from the plug pins and disposed between the wall and respective terminals, wherein after the wires form loops, the wires extend between and are movably held in place between the wall and respective posts.

9. The rotatable electrical plug assembly of claim 8, wherein the wall and the posts are made of a flexible material.

10. A volatile material dispenser, comprising:

a housing adapted to receive a container; and an electrical plug assembly rotatably retained within an opening of the housing, wherein the plug assembly includes a support block, electrical plug pins extending outwardly from the support block, and terminals extending from the plug pins; and wires extending from the terminals in a first direction perpendicular to the plug pins, wherein the wires form loops within the support block and further extend in a second direction opposite the first direction.

11. The volatile material dispenser of claim 10, wherein the wires are routed within the plug assembly in a plane that is generally perpendicular to the electrical plug pins.

12. The volatile material dispenser of claim 11, wherein the wires are routed into the volatile material dispenser in a direction that is generally coincident with the plane and generally perpendicular to the plug pins.

13. The volatile material dispenser of claim 10, wherein the loops allow the wires to be pushed and pulled during rotation of the plug assembly with little strain on the wires at the terminals.

14. The rotatable electrical plug assembly of claim 13, further including a wall projecting from the support block away from the plug pins and posts projecting from the support block away from the plug pins between the wall and respective terminals, wherein after the wires form loops, the wires extend between and are movably held in place between the wall and respective posts.

15. A method of reducing strain in a wire connected to an electrical plug assembly of a volatile material dispenser, the method including the steps of:

providing a volatile material dispenser having a housing adapted to receive a container;

providing an electrical plug assembly within an opening in the housing, wherein the plug assembly includes a support block having first and second opposing lateral sides and electrical plug pins extending from the support block and including terminals at an end thereof; and routing a wire from one of the terminals toward the first side of the support block, wherein the wire forms a loop between the terminals and the first side within the support block and then extends toward the second side of the support block.

16. The method of claim 15, further including the step of routing the wires in a plane that is perpendicular to the electrical plug pins.

17. The method of claim 16, further including the step of routing a second wire from the other of the terminals toward the first side of the support block, wherein the second wires forms a second loop between the terminals and the first side and then extends toward the second side of the support block.

18. The method of claim 17, further including the step of rotating the plug assembly and, during rotation, allow the wires to be pushed and pulled with little strain on the wires at the terminals.

19. The method of claim 18, further including the step of guiding the wires with a centrally located wall.

20. The method of claim 19, further including the step of movably restraining each of the wires between the wall and a post.

* * * * *